United States Patent [19]

Victorovich et al.

[11] 4,415,356

[45] Nov. 15, 1983

[54] PROCESS FOR AUTOGENOUS OXYGEN SMELTING OF SULFIDE MATERIALS CONTAINING BASE METALS

[75] Inventors: Grigori S. Victorovich; Malcolm C. Bell, both of Toronto, Canada

[73] Assignee: Inco Limited, Toronto, Canada

[21] Appl. No.: 310,524

[22] Filed: Oct. 13, 1981

[30] Foreign Application Priority Data

Oct. 1, 1980 [GB] United Kingdom ..... 8035134
Nov. 4, 1980 [GB] United Kingdom ..... 8035417

[51] Int. Cl.[3] ..... C22B 1/02

[52] U.S. Cl. ..... 75/21; 75/7; 75/23; 75/73; 75/82

[58] Field of Search ..... 75/7, 21, 23, 73, 82

[56] References Cited

U.S. PATENT DOCUMENTS 3,589,892 6/1971 Peterson ..... 75/72
3,988,148 10/1976 Queneau ..... 75/72

FOREIGN PATENT DOCUMENTS 503446 6/1954 Canada .
934968 10/1973 Canada .

OTHER PUBLICATIONS

Yannopoulos, "Extractive Metallurgy of Copper," vol. I, pp. 439–457, AIME, (1967).
Melcher, "The KIVCET Cyclone Smelting Process for Impure Copper Concentrates", JOM; pp. 4–32, (7/1976).

*Primary Examiner*—Peter D. Rosenberg
*Attorney, Agent, or Firm*—Ewan C. MacQueen; Raymond J. Kenny

[57] ABSTRACT

An autogeneous smelting process for suldie materials using a roasted portion blended with unroasted material in the presence of a flux.

16 Claims, No Drawings

PROCESS FOR AUTOGENOUS OXYGEN SMELTING OF SULFIDE MATERIALS CONTAINING BASE METALS

BACKGROUND OF THE INVENTION AND THE PRIOR ART

Oxidation smelting of base metal sulfide materials, including concentrates, has become a useful process which has been adapted in many countries for the treatment of a variety of sulfide material. Metal sulfide materials which may be treated by this technique contain a variety of valuable metals including copper, nickel, cobalt, lead, zinc, etc. Usually valuable metal sulfide ores and concentrates will also contain large amounts of iron sulfides such as pyrite and pyrrhotites and can contain undesirable impurities such as arsenic, bismuth, etc. Sulfide mineralization frequently occurs in admixture, e.g., copper with zinc and/or lead, copper with nickel, etc. Metal sulfide concentrates generally are finely divided.

In oxidation smelting the finely divided metal sulfide material, such as sulfide concentrate, in admixture with a flux material for iron oxide, e.g., silica, is first dried to eliminate water and then is injected along with an oxygen containing gas which can be oxygen enriched air or commercial oxygen by means of a suitable device which may be a burner. Part of the iron and sulfur contents of the concentrate burn with the combustion being supported by oxygen in the gas injected with the result that combustion preferably is autogenous. For example, in autogenous flash smelting the mixture of concentrate plus oxygen or oxygen enriched air is injected into a refractory furnace in a manner such that the oxidation of the sulfide occurs in the freeboard space of the furnace and the molten products of the combustion fall into the hearth of the furnace. The valuable metals are collected in the matte phase. The oxidized iron is fluxed by the silica to form a slag which collects on top of the molten matte. As desired, the matte and slag can be tapped at intervals. The process affords a means for smelting large quantities of sulfides on a continuous basis with generation of an off gas which can be 80% or more sulfur dioxide when the oxidizing gas consists of 100% commercial oxygen. The rich off-gas lends itself readily to treatment for recovery of liquid sulfur dioxide or for manufacture of sulfuric acid thereby making the operation highly advantageous for an environmental aspect. Another advantage of the process resides in the fact that the fuel for the process is iron sulfide which itself is not particularly valuable.

There is a well established prior art in regard to oxidation smelting and the technique is used throughout the world. As examples Canadian Pat. Nos. 503,446 and 934,968 may be mentioned together with the book "The Winning of Nickel" by J. R. Boldt and P. Queneau, Longman's, Canada, at pages 244 to 247 and various articles including the paper, "Oxygen Flash Smelting in a Converter" by M. C. Bell, J. A. Blanco, H. Davies and R. Sridhar, J. of Metals, Vol. 30, No. 10, pages 9–14, 1978; "Smelting Nickel Concentrates in Inco's Oxygen flash Furnace", by M. Solar et al., 107th AIME Annual Meeting, Denver, Colorado, Feb. 26–Mar. 2, 1978, "The KIVCET Cyclone Smelting Process for Impure Copper Concentrates" by Melcher, E. Muller and H. Weigel, J. of Metals, July 1976, pages 4–8; Paper by T. Nagano and T. Suzukii "Commercial Operation of Misu-Bishi Continuous Copper Smelting and Converting Process", published in *Extractive Metallurgy of Copper*, edited by J. C. Yannopoulas and J. C. Agarwal, the Metallurgical Society of AIME, 1976, Vol. 1, pages 439–457.

It is found that with any particular oxidation smelting furnace, it is necessary to arrive at a thermal equilibrium which is dependent upon the proportion of the sulfide concentrate burned. The heat generated by the combustion of the furnace feed, essentially of labile S and FeS to $SO_2$ and iron oxides, equals the heat content of the smelting products (matte, slag and off-gas) plus the furnace heat losses. This means that, for a given sulfide material and a given furnace, a sufficient amount of oxygen per unit weight of sulfides must be supplied to satisfy the heat balance of the operation. When this is done, the matte grade is fixed, and the amount of oxygen cannot be altered without producing either an excess or deficiency of heat. In other words, the furnace balance, all other things being equal, determines the matte grade or the overall degree of conversion of the sulfide materials into a final product. This rigid interdependence of heat balance and degree of conversion is an important limitation of these processes. The present invention is directed to a means for controlling matte grade in oxidation smelting, e.g., autogenous flash smelting, at will.

The above mentioned interdependence of heat balance and degree of conversion of the concentrate in oxidation smelting, in particular autogenous oxygen flash smelting, makes it difficult to obtain the desired matte grades, especially when the concentrate has a low copper content and a high iron content. The interdependence of heat balance and matte grade applies to all of the aforementioned oxidation smelting processes.

It is to be appreciated that in the smelting of copper, as an example, the matte generated in the smelting furnace must be subjected to further treatment to provide blister copper which can in turn be transformed into high purity copper products. The smelting furnace matte grade controls the supplementary operations which must be performed downstream so as to arrive at blister copper. Thus, the higher the grade of the smelting furnace copper matte, the less needs to be done in converters or other equipment so as to provide blister copper and the less difficult are the problems in meeting environmental standards in regard to the evolution of sulfur dioxide in such downstream operations. In some cases, it may be desirable for example to provide a matte from the smelting furnace having the composition of white metal, almost pure $Cu_2S$.

A number of methods have been proposed for controlling the matte grade in oxygen flash smelting. Among these are: adding to the concentrate revert materials, such as dust, ground matte and slag skulls, etc.; water injection into the smelting unit; air dilution of the oxygen. All these alternatives consist of introducing a coolant into the smelting unit to use up the excess heat generated when a matte grade higher than that normally obtained in autogenous flash smelting is desired. They provide a way of achieving the same end result as the process of the present invention but they are not as attractive because higher oxygen additions are required and the processes become wasteful in energy utilization.

SUMMARY OF THE INVENTION

The invention is based on the discovery that in the oxidation smelting the matte grade generated in the smelting furnace can be controlled by dividing the metal sulfide material stream to be smelted such that a portion of the stream is subjected to at least partial or even dead roasting, is then mixed with additional fresh metal sulfide material before being fed to the flash smelting furnace along with flux in the usual manner. This technique permits an upgrading in the matte grade produced, and is particularly applicable to oxygen flash smelting.

DETAILED DESCRIPTION OF THE INVENTION

It will be appreciated by those skilled in the art that process metallurgists involved with the milling and smelting of metal sulfide deposits will control the mill and smelter to provide the most efficient process which can be devised for treating the product of a particular ore body or available combinations of ore bodies. Despite the ingenuity of metallurgists involved in the recovery of the valuable minerals from ores the concentrate which is produced in the mill will vary greatly depending upon the nature of the ore. Thus, valuable copper minerals such as chalcopyrite, chalcocite, etc. usually occur in ore bodies wherein large quantities of iron sulfides which can be pyrite, pyrrhotite, etc. also can occur. In addition, certain copper sulfide minerals also include iron, as an example, chalcopyrite. A similar situation occurs with nickel sulfide and other base metal sulfide minerals.

For example, if the ratio of iron sulfide to copper sulfide in the concentrate is high, the material will normally yield a low matte grade on autogenous oxygen smelting. In this case, the objective of the present invention is to adjust the ratio of iron sulfide to copper sulfide in the smelting furnace feed so as to obtain the desired matte grade. This is achieved by partial or dead roast of a portion of the concentrate. Similar considerations apply to nickel sulfide or other base metal sulfide concentrates.

It will be appreciated that the roasting step which forms part of the invention may be accomplished in equipment such as a fluid bed roaster. When this is done, a gas containing at least 10% of sulfur dioxide is produced which may be employed as feed for a sulfuric acid plant. In this way sulfur removed from the portion of concentrate which is roasted can be recovered and is not discharged to the atmosphere. Roasting in the fluid bed can be accomplished using air as the oxidant.

The blend of roasted and dry unroasted concentrate, mixed with silicious flux, is injected into the smelting furnace in a stream of oxygen. The desired composition of matte to be obtained can be controlled by adjusting the ratio of calcine to green sulfide material in the feed. For a given concentrate, heat balance calculations will dictate the relative proportions of calcine and green sulfide material which have to be fed to yield the desired product on autogenous smelting.

The process of the present invention makes it possible to autogenously smelt copper concentrates of any composition to yield matte of desired grade. Thus, it becomes possible, in a one-step smelting operation, to smelt directly to white metal ($Cu_2S$) or blister or crude copper. When white metal is produced, it can be converted to blister copper in a second autogenous oxidation smelting operation. In a similar manner, a low iron (1% Fe) matte can be produced directly from nickel concentrates. Since a richer matte grade is achieved, in respect of the metal value being recovered, less converting is required downstream of the flash smelter again with benefits in terms of reduced fugitive emissions of sulfur dioxide. In the treatment of copper concentrates having high levels of other metals such as zinc and/or lead, matte grade control can be used to promote separation of copper from such other metals.

This invention provides advantages with respect to alternative methods for controlling the matte grade by adding coolants (reverts, scrap, water, etc.) to the smelting furnace. Less oxygen is required in the flash furnace since the fuel value of the concentrate is lowered to the required level by oxidation of a portion of its iron and sulfur content prior to the flash smelting operations. As a consequence there is an increase in the specific capacity of the furnace and less dusting due to the oxygen requirement per unit weight of feed thereby generating a lower volume of gases produced. As compared to a process using air dilution to control matte grade, the present process provides lower furnace off-gas volume, decreased dusting and lower capital requirement for off-gas treatment apparatus.

Direct production of very high-grade copper mattes, i.e. mattes over 60% copper, in the smelting unit will result in furnace slags which will require treatment for base metal recovery before being discarded. In the case of oxygen flash smelting of copper concentrates, the slag cleaning can be accomplished by a number of known processes such as treating the slag in a separate electric furnace as described by Brick et al. in the article "Flash Smelting of Copper Concentrate", J. of Metals, vol. 10(6), 1958, pp. 395–400; in a separate flash furnace with lower matte grade as described in Canadian Pat. No. 503,446; or by slow-cooling as described by Subramanian and Themelis in J. of Metals, vol. 24(4), 1972, pp. 33–38. The low grade matte or concentrate obtained from the slag cleaning operation may be recycled to the primary smelting unit. In the case of nickel, the slags from the primary smelting furnace can be cleaned in an electric furnace as described in "The Latest Development in Nickel Flash Smelting at the Harjavalta Smelter" by T. Niemela and S. Harkii, Joint Meeting MMIJ-AIME, 1972, Tokyo. Because nickel concentrates usually contain a significant amount of cobalt, which will report mainly in the slag of the primary smelting unit, the electric furnace slag cleaning operation will yield a secondary matte enriched in cobalt which can be processed separately by conventional methods to recover this metal as well as the nickel and other metal values.

Some examples will now be give:

EXAMPLES

EXAMPLE I

A chalcopyrite type of copper concentrate analyzing (wt.%): 29.7 Cu, 1.0 Ni, 30.7 Fe, 35.2 S was roasted with air at 800° C. to yield a calcine with the following composition (wt.%): 35.0 Cu, 1.2 Ni, 37.8 Fe, 0.8 S. The Cu and the Fe in the calcine were mainly as $CuFe_2O_4$. Minor amounts of CuO and $Fe_2O_3$ were also present. Blends of this calcine and green concentrate were oxygen flash smelted in a miniplant flash furnace with sufficient oxygen to simulate a commercial autogenous operation. The amount of oxygen required for this purpose was calculated from heat and mass balances which predicted the matte grades which would be obtained in the commercial furnace at the various experimental calcine/green concentrate ratios. The blends of calcine and green concentrate were fed to the miniplant furnace at a rate of 8–9 kg/h. The flashing space temperature was about 1400° C. The following table summarizes the results:

TABLE

| % Calcine Added by Weight of Green Concentrate | Matte Grade, % (Cu + Ni)* | | Slag Composition (%) | | |
|---|---|---|---|---|---|
| | Expected** | Obtained | $SiO_2$ | Fe | Cu |
| 0 | 40.0 | 42.4 | 30.7 | 37.0 | 0.7 |
| 5.5 | 48.5 | 50.8 | 30.6 | 40.8 | 0.67 |
| 11.1 | 58.5 | 58.6 | 35.0 | 34.7 | 1.19 |
| 22.5 | 77.0 | 75.0 | 33.5 | 34.9 | 4.77 |

*% Ni in mattes: 1.5
**Predicted from heat and mass balance calculations for an autogenous operation.

The results clearly show that matte grade is controlled in accordance with precepts of the invention wherein a portion of the concentrate is pre-roasted prior to smelting.

The slags were fluid in all the above tests. Excellent separation of mattes from slags was observed.

EXAMPLE II

A copper concentrate and calcine of the same compositions as in Example I were blended in a proportion of 100:30 and flash smelted with oxygen in the miniplant flash furnace. According to the heat and mass balance calculations for the commercial autogenous operation, the proportion of oxygen, concentrate and calcine used in this example was expected to yield a final copper product close in composition to metallic copper. After smelting under conditions similar to those in Example I, the following products were obtained:

| | Composition, wt. % | | | | | | | | |
|---|---|---|---|---|---|---|---|---|---|
| | Cu | Ni | Fe | S | $SiO_2$ | $Al_2O_3$ | CaO | MgO | $Fe_3O_4$ |
| Crude Copper | 97.2 | 0.68 | 0.02 | 1.0 | — | — | — | — | — |
| Slag | 10.5 | 0.59 | 38.0 | 0.02 | 20.5 | 2.38 | 7.7 | 2.3 | 32.3 |

The slag was slowly cooled, comminuted and subjected to froth flotation, resulting in slag copper concentrate containing 70.4% Cu and slag flotation tails containing only 0.53% Cu.

This example illustrates how this invention can provide for directly obtaining a product of as high grade as crude copper, in one stage oxidation smelting process under autogenous conditions and at very high extraction of copper.

EXAMPLE III

One part of a nickel concentrate calcine analyzing (wt.%): 10.0 Ni, 2.9 Cu, 41.7 Fe, 0.33 Co, 9.5 $SiO_2$, 6.8 S was mixed with four parts of a green concentrate analyzing (wt.%): 15.1 Ni, 1.9 Cu, 0.5 Co, 38.5 Fe, 6.75 $SiO_2$ 32.0 S. The blend was oxygen flash smelted in a miniplant flash furnace at a rate of 8 kg/h and at a temperature in the flashing space of about 1400° C. The amount of oxygen was also determined from the heat and mass balance calculations to simulate a commercial autogenous operation. The matte obtained analyzed in wt %; 54.8 Ni, 9.9 Cu, 0.79 Co, 8.4 Fe, 23.7 S and the slag obtained analyzed in wt %; 0.54 Cu, 2.8 Ni, 0.3 Co, 33.1 Fe, 0.15 S, 38 $SiO_2$, 6.8 $Al_2O_3$, 10 $Fe_3O_4$. The iron-silica slag was fluid and separated well from the matte. The results of this test demonstrated that oxygen flash smelting of nickel calcine-green nickel concentrate blends is technically feasible.

EXAMPLE IV

One part of the same nickel calcine was blended with 2.33 parts of the same nickel concentrate and the blend was oxygen flash smelted under conditions expected to yield a matte with only about 1.5% Fe. The following products were obtained:

| | Composition, wt. % | | | | | | | |
|---|---|---|---|---|---|---|---|---|
| | Cu | Ni | Co | Fe | S | $SiO_2$ | $Al_2O_3$ | $Fe_3O_4$ |
| Matte | 14.6 | 61.9 | 0.18 | 1.8 | 21.6 | — | — | — |
| Slag | 0.81 | 6.0 | 0.43 | 36.8 | 0.05 | 31.2 | 4.6 | 16.0 |

The iron silicate slag was fluid and separated well from the matte.

The results of these tests demonstrated clearly that the oxidation smelting of nickel calcine/nickel green concentrate blends can autogenously be effected up to the very high matte grade, in fact, up to the grade which is known as a nickel converter matte.

Although the present invention has been described in conjunction with preferred embodiments, it is to be understood that modifications and variations may be resorted to without departing from the spirit and scope of the invention, as those skilled in the art will readily understand. As an example, it is preferred to dead roast only a proportion of concentrate fed to the smelter since in this way materials handling is minimized. If desired, all of the concentrate feed could be partially roasted. Similarly, other sulfide materials equivalent in general metallurgical characteristics to sulfide concentrates, e.g., furnace mattes, can be treated in accordance with precepts of the invention. As noted hereinbefore, for a given sulfide material and a given furnace a sufficient amount of oxygen per unit weight of sulfides must be provided to supply the heat balance of the operation. Thus, for a given sulfide material, heat balance calculations will establish the relative proportions of calcined and uncalcined material to be employed, matte grade, or whether the given sulfide material is treatable by oxidation smelting. It will be apparent from the foregoing description that oxidation smelting, e.g., autogenous oxygen flash smelting, can be carried out in two stages. Thus copper concentrate can be flash smelted in a first operation to a matte grade of about 55% while producing a slag which can be discarded; the matte can be granulated, ground and smelted in a second flash smelter to yield white metal of blister copper with the slag from the second flash smelter being returned to the first smelter operation. Alternatively the slag from the second operation can be slow cooled, concentrated and the concentrate returned. Calcine can be fed to either or both of the flash smelting operations along with the sulfide feed in accordance with heat balance requirements and to control product grade therefrom. Such modifications and variations are considered to be within the purview and scope of the invention and appended claims.

The embodiments of the invention in which an exclusive property or privilege is claimed are defined as follows:

1. A smelting process in which a sulfide material containing metal sulfide values and iron sulfide is combusted autogenously with an oxygen-containing gas comprising roasting a portion of the sulfide material to be smelted, blending the thus roasted portion with unroasted sulfide material, and autogenously smelting the resulting blend of roasted and unroasted material with oxygen in a bounded space and in the presence of a flux for iron oxides to produce a molten metal product, a molten silicious slag and a strong sulfur dioxide off-gas, whereby the grade of said molten metal product is higher than it would have been had only said unroasted sulfide material been fed to said autogenous smelting.

2. A process according to claim 1 in which the autogenous combustion is effected by oxygen flash smelting.

3. A process in accordance with either of claims 1 or 2 in which said sulfide material is a copper concentrate.

4. A process in accordance with either of claims 1 or 2 in which said sulfide material is a nickel concentrate.

5. A process in accordance with either of claims 1 or 2 in which said sulfide material is a furnace matte.

6. A process in accordance with either of claims 1 or 2 in which said roasting is conducted in a fluid bed to produce a strong sulfur dioxide-containing off-gass which can be converted to sulfuric acid.

7. A process in accordance with either of claims 1 or 2 in which all of the feed to autogenous smelting is partially roasted.

8. A process in accordance with either of claims 1 or 2 in which the portion of roasted feed is dead roasted.

9. A process in accordance with either of claims 1 or 2 in which the portion of roasted feed is partially roasted.

10. A process in accordance with either of claims 1 or 2 in which the grade of said molten metal product increases as the proportion of roasted sulfide to unroasted sulfide in the smelter feed increases.

11. A process in accordance with claim 3 wherein the roasted and unroasted portions of said concentrate are proportioned to provide essentially $Cu_2S$ in said molten metal product and said $Cu_2S$ is converted to blister copper in a second autogenous oxidation step.

12. A process in accordance with claim 1 wherein said molten metal product is a matte containing at least about 60% copper.

13. A process in accordance with claim 1 wherein said molten metal product is white metal ($Cu_2S$).

14. A process in accordance with claim 1 wherein said molten metal product is crude copper.

15. A process in accordance with any of claims 1, 2 or 3 in which the smelting is carried out in more than one furnace and calcine is intermixed with the feed to any or each of said smelting furnaces.

16. A process in accordance with any of claims 1, 4 or 8 in which the smelting is carried out in more than one furnace and calcine is intermixed with the feed to any or each of said smelting furnaces.

* * * * *